US006382117B2

(12) United States Patent
Cardoso et al.

(10) Patent No.: US 6,382,117 B2
(45) Date of Patent: May 7, 2002

(54) SEWING MACHINE NEEDLE HAVING A T-SHAPED SHANK

(76) Inventors: Arivaldo Viera Cardoso; Luiz Carlos de Araujo, both of Avenida Presidente Vargas, 844, Indaiatuba - SP CEP 13330-000 (BR)

( * ) Notice: Subject to any disclaimer, the term of this patent is extended or adjusted under 35 U.S.C. 154(b) by 0 days.

(21) Appl. No.: 09/815,740

(22) Filed: Mar. 23, 2001

(51) Int. Cl.[7] ..... D05B 85/02
(52) U.S. Cl. ..... 112/222
(58) Field of Search ..... 112/222, 226; 163/1, 4, 5

(56) References Cited

U.S. PATENT DOCUMENTS

| | | | | | |
|---|---|---|---|---|---|
| 278,857 | A | * | 6/1883 | Berwick | 112/226 |
| 2,074,942 | A | * | 3/1937 | Scoma | 112/226 |
| 2,092,929 | A | | 9/1937 | Ovington | |
| 2,698,589 | A | * | 1/1955 | Johnson | 112/226 |
| 4,519,330 | A | | 5/1985 | Zylbert et al. | |
| 4,524,815 | A | | 6/1985 | Pavel et al. | |

FOREIGN PATENT DOCUMENTS

| | | | | |
|---|---|---|---|---|
| DE | 921732 | * | 12/1954 | 112/226 |
| DE | 3201285 A | | 7/1983 | |
| GB | 807705 A | | 1/1959 | |
| RU | 1057590 | * | 11/1983 | 112/222 |

* cited by examiner

*Primary Examiner*—Ismael Izaguirre

(57) ABSTRACT

A new disposition is introduced into the shank of a sewing machine needle defining a shank (1), a shoulder (2), a blade (3), a clearance above eye (4), an eye (5) and a point (6). The shank (1) presents two transverse sections forming a T-shaped profile according to the sections BB and CC, and the T-shaped profile defines a unique height (G2) along an extent (S5) of the shank (1), and a unique width (S4) on a line (C1) extending along an area of a section (T1) of the extent (S5) that is equal to a width (S4) on a line (C2) of another section of the extent (S5).

5 Claims, 1 Drawing Sheet

ESC. 4:1

Section CC

ESC. 10:1

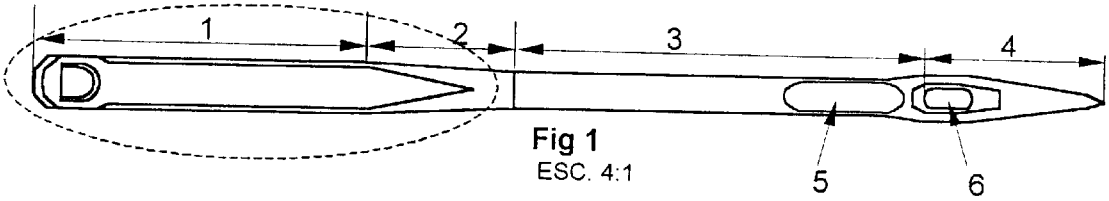
Fig 1
ESC. 4:1
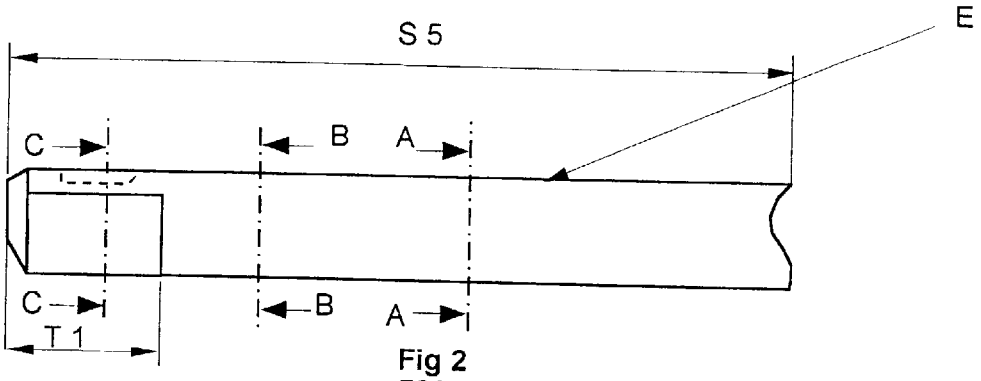
Fig 2
ESC. 10:1
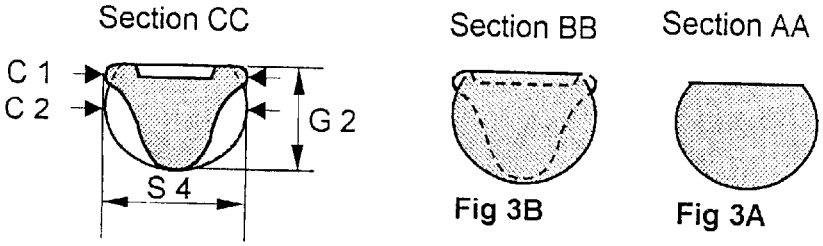
Fig 3B
Fig 3A
ESC. 10:1 Fig 3C

SEWING MACHINE NEEDLE HAVING A T-SHAPED SHANK

PRIORITY CLAIM

The present application claims convention priority on Brazilian Patent Application No. MU 8000707-4, filed Mar. 24, 2000, now Brazilian Patent No. 8000707-4, which is hereby expressly incorporated by reference as part of the present disclosure.

FIELD AND BACKGROUND OF THE INVENTION

The present invention relates to a new disposition introduced into the shank of a sewing machine needle as formed to convert the needle to a universal-type needle, i.e., one utilizable in any of numerous different types of sewing machines.

BRIEF DESCRIPTION OF THE DRAWINGS

To better comprehend the preferred embodiment of the present invention, it is hereinafter described in connection with the attached drawings, where:

FIG. 1 is a side elevational view of a preferred embodiment of the needle for sewing machines incorporating the new disposition introduced into the shank in accordance with the present invention.

FIG. 2 is a partial, detailed view of the shank of the needle of FIG. 1; and FIGS. 3A, 3B and 3C are transverse, cross-sectional views of the shank of the needle illustrated in FIG. 2 taken along sections AA, BB and CC, respectively, of FIG. 2.

SUMMARY OF THE INVENTION

The present invention is directed to a sewing machine needle comprising a shank (1) formed on one end of the needle, a shoulder (2) extending inwardly from the shank, a blade (3) formed on the opposite side of the shoulder relative to the shank, an eye (5) formed at the distal end of the blade (3), a clearance (4) formed at the opposite end of the needle relative to the shank (1), and a point (6) formed on the clearance (4). The shank (1) defines. in a first section (T1) adjacent to the end of the needle forming an approximately T-shaped profile defining a first laterally-extending portion having an outermost dimension or width (S4), and a second laterally-extending portion oriented transverse to the first laterally-extending portion and defining at outermost dimension or height (G2). The two laterally-extending portions form the T-shaped profile of the shank (1). The shank (1) further defines a second section (BB, AA) having an approximately circular peripheral surface and defining an outermost dimension or width (S4) approximately equal to the outermost dimension or width (S4) of the first laterally-extending portion of the T-shaped profile. Preferably, an approximately flat surface portion (E) extends in the axial direction along a peripheral surface portion of the shank (1).

In the preferred embodiment of the present invention, the ratio of the height (G2) to the width (S4) is within the range of approximately 1 to approximately 1.275, and the ratio of the length of the first section (T1) of the shank (1) to the overall length (S5) of the shank is within the range of approximately 1 to approximately 5.85.

Numerous objects and advantages of the present invention will become readily apparent in view of the following detailed description of the preferred embodiment and the accompanying drawings.

DETAILED DESCRIPTION OF THE PREFERRED EMBODIMENT

As shown in the Figures, the main parts of the needle for a household sewing machine are: the "shank 1", "shoulder 2", "blade 3", "clearance above eye 4", "eye 5" and "point 6".

As shown in FIG. 2, the flat area E of the "shank 1" of the needle extending between the sections BB and AA defines the correct position for fixing the needle on the sewing machines for household use produced by several manufacturers of such sewing machines. This area E may be formed by any of several different processes of pressing or grinding; for example, the denominated needle with the shank formed by pressing may be manufactured in accordance with the detailed description and illustrations of U.S. Pat. No. 4,519,330.

To guarantee that the needle has only one-way for insertion/fixation on the sewing machines of several manufacturers, the geometry of "shank 1" is dimensioned in such a way that it can be produced by a pressing operation producing two sections including a profile according to section BB, and a profile according to section CC defining a "T" shape, as shown in FIGS. 3B and 3C, respectively.

With reference to FIG. 3C, the dimension or height G2 of the T-shaped portion shown in FIG. 3C is unique along the extent S5 of the shank of the needle (as shown in FIG. 2), and the section CC defining the T-shape provides a dimension or width S4 on the line C1 extending along the area T1 of section CC (shown in FIG. 2) that equals a dimension or width S4 on the line C2—as shown in sections BB and AA—of the extension S5. The unique dimension G2 on the pressed area of the shank, and the dimension or width S4 on the section CC guarantee a condition to use devices for fixation of the needles on household sewing machines with a unique form for insertion/fixation (i.e., one-way insertion) of the needle on the sewing machine, defining with this new form of shank a possible condition to be utilized with a "go—no go" function on the extremity T1 of the "shank 1" of the needle for sewing.

The dimensional relation between the height G2 and the width S4 of the transverse sections defining the T-shaped portion of the "shank 1" is about 1 to about 1.275 and the relation between T1 and S5 is about 1 to about 5.85.

Accordingly, the preferred embodiment of the present invention provides a new disposition introduced on the shank of the needle for a sewing machine, wherein the needle defines a "shank 1", a "shoulder 2", a "blade 3", a "clearance above eye 4", an "eye 5" and a "point 6", and characterized by the "shank 1" presenting two transverse sections defining a T-shaped profile according to the sections BB and CC, and wherein the T-shaped profile defines a unique dimension or height G2 along an extension S5 of the shank, and a unique dimension or width S4 on the line C1 along the area or section T1 of the section CC that is approximately equal to a dimension or width S4 on the line C2 of the sections BB and AA of the shank.

As may be recognized by those of ordinary skill in the pertinent art based on the teachings herein, numerous changes and modifications may be made to the above-described and other embodiments of the present invention without departing from its scope as defined in the appended claims. Accordingly, this detailed description of a preferred embodiment is to be taken in an illustrative as opposed to a limiting sense.

What is claimed is:

1. A sewing machine needle, comprising:

a shank (1) formed on one end of the needle;

a shoulder (2) extending inwardly from the shank;

a blade (3) formed on an opposite side of the shoulder relative to the shank;

an eye (5) formed on the blade (3);

a clearance (4) formed on an opposite side of blade relative to the shoulder; and a point (6) formed on the clearance (4), wherein the shank includes a first section (T1) adjacent to the end of the needle forming an approximately T-shaped profile including a first laterally-extending portion having a first outermost dimension (S4), and a second laterally-extending portion oriented transverse to the first laterally-extending portion and defining a second outermost dimension (G2), wherein the two laterally-extending portions form the T-shaped profile of the shank (1), and wherein the shank further defines a second section (BB, AA) spaced inwardly relative to the first section (T2) having an approximately circular peripheral surface and defining a third outermost dimension (S4) approximately equal to the first outermost dimension (S4) of the first laterally-extending portion of the T-shaped profile (T1).

2. A sewing machine needle as defined in claim 1, wherein the shank (1) further defines an approximately flat surface portion (E) that extends in the axial direction along a peripheral surface portion of the shank (1).

3. A sewing machine needle as defined in claim 1, wherein the first outermost dimension (S4) defines the width of both the first laterally-extending portion of the T-shaped profile (T1) and the width of the second section (BB, AA), and the third outermost dimension (G2) defines the height of the second laterally extending portion.

4. A sewing machine needle as defined in claim 1, wherein the dimensional relation between the length of the first section (T1) and the length of the shank (S5) is within the range of about 1 to about 5.85.

5. A sewing machine needle as defined in claim 3, wherein the dimensional relation between the height (G2) and width (S4) of the transverse sections of the T-shaped profile of the shank (1) is within the range of about 1 to about 1.275.

* * * * *